United States Patent [19]

Witt et al.

[11] Patent Number: 4,622,901

[45] Date of Patent: Nov. 18, 1986

[54] WARHEAD

[75] Inventors: Wolfram Witt, Duesseldorf; Herbert Scholles, Meerbusch, both of Fed. Rep. of Germany

[73] Assignee: Rheinmetall GmbH., Duesseldorf, Fed. Rep. of Germany

[21] Appl. No.: 676,663

[22] Filed: Nov. 30, 1984

[30] Foreign Application Priority Data

Nov. 30, 1983 [DE] Fed. Rep. of Germany ..... 33432651

[51] Int. Cl.[4] ..... F42B 11/22

[52] U.S. Cl. ..... 102/476; 102/214; 102/306

[58] Field of Search ..... 102/305, 306, 475, 476, 102/501, 214

[56] References Cited

U.S. PATENT DOCUMENTS 2,849,957 9/1958 Kuller et al. ..... 102/476
3,913,488 10/1975 Dunetz ..... 102/501
4,050,381 9/1977 Heinemann ..... 102/476

FOREIGN PATENT DOCUMENTS 1090957 4/1955 France ..... 102/476
1293794 4/1962 France ..... 102/476

*Primary Examiner*—Harold J. Tudor

[57] ABSTRACT

A warhead includes a housing in which an effective explosive charge and a projectile-forming layer is disposed. The effective explosive charge is connected and ignited by a target recognition device. In order to reduce the effect of the antenna as a hindrance and obstacle to the formation of a projectile by means of a projectile-forming layer forming part of the effective explosive charge, the antenna extends only to a limited extent into the central region of the end face of the effective charge and is in the form of an annular shape which only to a minor degree covers the projectile-forming layer so that only the peripheral surfaces of the projectile-forming layer are blocked by the antenna structure.

5 Claims, 5 Drawing Figures

WARHEAD

BACKGROUND OF THE INVENTION

The invention relates to a warhead which is adapted to be expelled from a carrier projectile or a flying body.

It has been determined that antenna-systems which are arranged in front of the effective load relative to the direction of flight are particularly advantageous for optimal target recognition. On the other hand, such arrangements of antenna-systems constitute a disturbing obstacle for the ejecting projectile which is produced by the effective charge at detonation and such antenna-systems can considerably detract from the effectiveness of the so-produced projectile.

SUMMARY OF THE INVENTION

It is an object of this invention to provide a new type of warhead with which, despite the arrangement of an antenna structure in front of the effective load relative to the direction of flight, an improved formation of the projectile and an increased destructive effect of the ejected projectile is possible.

The arrangement of the invention therefore utilizes in an advantageous manner, on the one hand, the known advantages of providing an antenna system and mounting same in front of the effective load and the projectile-forming layer relative to the direction of flight and, on the other hand, makes possible in addition thereto an increase in destructive output of the warhead.

BRIEF DESCRIPTION OF THE DRAWINGS

With these and other objects in view, which will become apparent in the following detailed description, the present invention will be clearly understood in connection with the accompanying drawings, in which.

DETAILED DESCRIPTION

Figure 1:
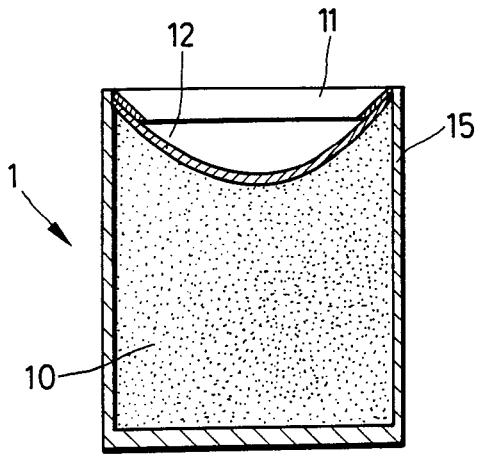
FIG. 1 is a schematic cross-sectional view of the warhead of this invention.

FIG. 1 illustrates schematically a warhead 1 which is mounted in a housing 15 and includes an effective load 10 as well as a projectile-forming layer 12. Such types of warheads are generally expelled from a carrier projectile or flying body over a target region and seek a target over such region while descending thereon. Once the target is recognized by the target recognition device, the effective charge 10 is ignited via the target recognition device and a projectile is formed from a projectile-forming layer 12 for combatting the target.

The means for igniting the effective charge 10 and the components of the target recognition device, which are not essential for an understanding of the invention, have not been illustrated in the schematic drawing of FIG. 1. The target recognition device can be of the active or passive type. An actively operating target recognition device emits first electromagnetic radiation and then receives a reflecting radiation from the target. A passively operating target recognition device evaluates, in contradistinction thereto, only those radiations which are emitted from the target itself. In both cases, an antenna-structure for emitting, respectively receiving the electromagnetic radiation is necessary. In order to achieve an optimum functioning of the antenna it should be mounted in front of all other structural components of the warhead 1 with respect to the direction of flight thereof. Such arrangement is already known from West-German published patent No. DE-PS No. 11 59 771.

Several design considerations must be met, and some of these have been found to be disadvantageous. In particular, in order to obtain a rugged construction which is capable to withstand the stresses produced at firing it is necessary to provide a relatively massive antenna structure which in turn inhibits the effectiveness of the projectile-forming charge.

Figure 2:
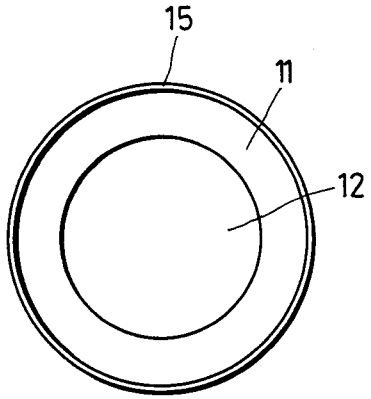
FIG. 2 is a top plan view of the projectile-forming layer of the warhead of FIG. 1.
Figure 4:
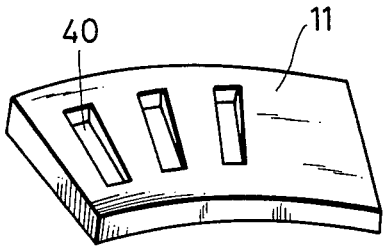
FIG. 4 is a section of the antenna at an enlarged scale shown in perspective.

In order to eliminate this drawback, the invention provides for an antenna structure 11, as illustrated in FIGS. 1 and 2, in which the antenna structure only requires an angularly shaped strip and thereby blocks off only the peripheral region of the projectile-forming layer 12. Such an antenna 11 can, for example, be of the planar antenna structural type (see FIG. 4) which structural type includes a large number of slits 40 acting as dipoles, which while producing a desired antenna diagram are circuit-connected in groups. The antenna 11 itself consists of a material having a good electric conductivity, for example, a metal such aluminum or copper, in which the slits 40 are disposed. These slits 40 are dimensioned in accordance with the operating wave lengths.

There are already known in the antenna technology suitable complementary antenna structures, with which, in lieu of the slits 40, the dipoles are manufactured out of conductive material, which is mounted on a di-electric support surface.

In particular with frequencies in the micro-wave region the antenna structure 11 preferably serves only as a reflector, that is only as part of an antenna system, which bundle the electromagnetic energy onto a non-illustrated receiving element, for example, a single dipole or an opening in a hollow conductor.

As is particularly visible from an inspection of FIG. 2, the antenna construction 11 in accordance with the invention represents virtually no obstacle for the projectile-forming layer 12 in view of the available central opening which at all times represents an open passage. After ignition of the effective load 10 there can be formed a projectile from the projectile-forming layer in a substantially undisturbed fashion which is then propelled from the warhead 1 onto the target.

In dependence with the type and shape of the projectile-forming layer 12, the projectiles formed therefrom can be of spherical or cylindrical symmetrical shapes.

In particular, the latter shapes furnish high end-ballistic outputs when their flight attitude can be controlled. In an advantageous further feature of the invention a means is provided for achieving this result. The flight attitude of projectiles having cylindrical-symmetrical structures can, insofar as no spin-stabilization is possible, be effected only by means of a guide structure or at least a guide-like structure for optimizing the flight attitude. A guide-like structure can be produced by means of the projectile formed from the projectile-forming layer 12 during the detonation process and be superposed on the projectile, in that the antenna 11 becomes an effective shape-producing material. For this purpose the antenna 11 has at its disposal material-reinforcing members 13 which extend in a radial direction and which are distributed uniformly about the periphery thereof. These material-reinforcements 13 furnish the material for the projectile, in particular in its edge regions, thereby providing a substantially stronger obstacle than the thinner regions of the antenna 11 disposed between the material-reinforcement 13, thereby forcing the edge regions of the projectile-forming layer 12 to assume a symmetrical shape. During the detonation process the rear region of the substantially cylindrically shaped formed projectile then assumes the guide-structure-functions.

Figure 3:
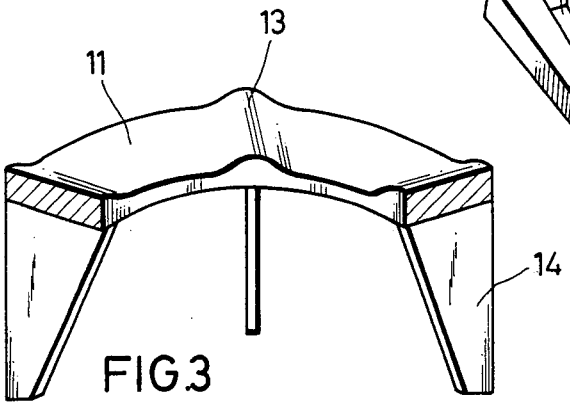
FIG. 3 is a detailed view in perspective of the antenna structure shown at an enlarged scale.

A mechanically stable and in particular firing-resistant construction of the antenna results from the mounting thereof by means of struts 14. These struts 14 extend at least partially through the effective load 10, and abut against the inner wall of the housing 15 of the warhead 1. In an enlarged view of a detail of FIG. 1 there is illustrated a portion of the antenna 11 together with the struts 14 and without the additional constructional elements of the warhead 1 (see FIG. 3).

The struts 14 advantageously are also uniformly spaced about the periphery of the antenna and end preferably in the region of the material-reinforcements 13 where they are joined to the antenna 11. By means of the struts 14, the final form of the guide structure of the projectile which is formed by the projectile-forming layer 12 can even be further improved.

Figure 5:
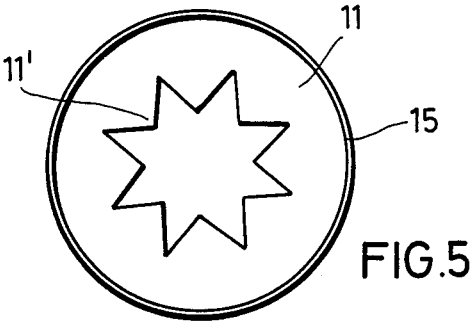
FIG. 5 is a second embodiment in plan view of an antenna construction in accordance with this invention.

In a further embodiment of the invention (FIG. 5) the antenna 11 has radially inwardly extending projections 11' which are uniformly spaced about the periphery of the antenna 11 and which define in the central region thereof a star-shaped opening. These extensions 11' further enhance the formation of a stable guide means during the formation of the projectile.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved warhead adapted to be expelled from a projectile or flying body during its flight phase, said warhead having electromagnetic radiation means forming target recognition means which include antenna means, a detonating charge being a shaped charge with a cavity and said detonating charge also includes a projectile-forming layer, and means for igniting the detonating charge when said target recognition means has recognized a target, the improvement comprising, wherein said antenna consists of a substantially annularly-shaped structure in contact with and blocking off an annular peripheral region of said projectile-forming layer.

2. The improved warhead as set forth in claim 1, wherein said annularly-shaped structure has a plurality of reinforcements equi-angularly disposed about the central axis thereof.

3. The improved warhead as set forth in claim 2, wherein said warhead includes a housing and said detonating charge being disposed in said housing, said annularly-shaped structure being connected to said housing via a plurality of radial struts which are equi-angularly disposed about said central axis, said struts extending at least partially through said detonating charge and line said housing.

4. The improved warhead as set forth in claim 3, wherein said struts are connected to said annularly-shaped structure at a region where said reinforcements are located.

5. The improved warhead as set forth in claim 1, wherein said annularly-shaped structure has a plurality of equi-angularly spaced radially inward projections.

* * * * *